US008899336B2

(12) United States Patent
Giroux et al.

(10) Patent No.: US 8,899,336 B2
(45) Date of Patent: Dec. 2, 2014

(54) ANCHOR FOR USE WITH EXPANDABLE TUBULAR

(75) Inventors: Richard Lee Giroux, Cypress, TX (US); Larry A. Kendziora, Needville, TX (US); Lev Ring, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 503 days.

(21) Appl. No.: 13/197,030

(22) Filed: Aug. 3, 2011

(65) Prior Publication Data

US 2012/0037381 A1 Feb. 16, 2012

Related U.S. Application Data

(60) Provisional application No. 61/371,082, filed on Aug. 5, 2010.

(51) Int. Cl.

| | |
|---|---|
| ***E21B 23/04*** | (2006.01) |
| ***E21B 43/10*** | (2006.01) |
| ***E21B 23/01*** | (2006.01) |

(52) U.S. Cl.

CPC ..... *E21B 23/01* (2013.01); *E21B 43/103* (2013.01)

USPC ..... 166/382; 166/210; 166/217; 175/57; 175/230

(58) Field of Classification Search

USPC ..... 166/206–217, 382, 77.53; 175/230

See application file for complete search history.

(56) References Cited

U.S. PATENT DOCUMENTS

| | | | | |
|---|---|---|---|---|
| 2,191,000 A | | 2/1940 | Thomas | |
| 2,827,966 A | | 3/1958 | Reynolds | |
| 3,043,372 A | * | 7/1962 | Davis | 166/140 |
| 3,045,757 A | | 7/1962 | Conrad | |
| 3,054,452 A | * | 9/1962 | Clark, Jr. et al. | 166/134 |
| 3,162,245 A | | 12/1964 | Howard et al. | |
| 3,167,122 A | | 1/1965 | Lang | |
| 3,175,618 A | | 3/1965 | Lang et al. | |
| 3,179,168 A | | 4/1965 | Vincent | |
| 3,191,677 A | | 6/1965 | Kinley | |
| 3,191,680 A | | 6/1965 | Vincent | |
| 3,203,451 A | | 8/1965 | Vincent | |
| 3,203,483 A | | 8/1965 | Vincent | |

(Continued)

FOREIGN PATENT DOCUMENTS

| | | |
|---|---|---|
| CA | 2298298 A1 | 8/2000 |
| GB | 2423321 A | 8/2006 |
| WO | WO-98/21444 A2 | 5/1998 |

OTHER PUBLICATIONS

Canadian Office Action dated Jul. 16, 2013, Canadian Patent Application No. 2,748,153.

(Continued)

*Primary Examiner* — Blake Michener

(74) *Attorney, Agent, or Firm* — Patterson & Sheridan, L.L.P.

(57) ABSTRACT

A method of lining a wellbore includes deploying a BHA into the wellbore using a conveyance. The BHA includes setting tool, an anchor, and an expandable tubular. The method further includes pressurizing a bore of the setting tool, thereby releasing the anchor from the setting tool. The method further includes pulling the conveyance, thereby: extending the anchor into engagement with a casing of the wellbore, pulling an expander of the setting tool through the expandable tubular, and expanding the tubular into engagement with an open and/or cased portion of the wellbore and retracting the anchor.

21 Claims, 12 Drawing Sheets

(56) References Cited

U.S. PATENT DOCUMENTS

| | | | | |
|---|---|---|---|---|
| 3,236,309 | A * | 2/1966 | Conrad | 166/120 |
| 3,358,760 | A | 12/1967 | Blagg | |
| 3,399,729 | A | 9/1968 | McGill | |
| 3,424,244 | A | 1/1969 | Kinley | |
| 3,489,220 | A | 1/1970 | Kinley | |
| 3,669,190 | A | 6/1972 | Sizer et al. | |
| 3,691,624 | A | 9/1972 | Kinley | |
| 3,780,562 | A | 12/1973 | Kinley | |
| 3,785,193 | A | 1/1974 | Kinley et al. | |
| 4,060,131 | A | 11/1977 | Kenneday et al. | |
| 4,530,398 | A * | 7/1985 | Greenlee et al. | 166/123 |
| 4,662,453 | A * | 5/1987 | Brisco | 166/387 |
| 4,715,445 | A | 12/1987 | Smith, Jr. | |
| 4,811,785 | A | 3/1989 | Weber | |
| 5,348,095 | A | 9/1994 | Worrall et al. | |
| 5,366,012 | A | 11/1994 | Lohbeck | |
| 5,785,120 | A | 7/1998 | Smalley et al. | |
| 6,021,850 | A | 2/2000 | Wood et al. | |
| 6,062,309 | A | 5/2000 | Gosse | |
| 6,386,292 | B1 | 5/2002 | Bland | |
| 6,408,945 | B1 | 6/2002 | Telfer | |
| 6,408,946 | B1 | 6/2002 | Marshall et al. | |
| 6,557,640 | B1 | 5/2003 | Cook et al. | |
| 6,622,678 | B2 | 9/2003 | Shimizu et al. | |
| 6,622,789 | B1 | 9/2003 | Braddick | |
| 6,691,777 | B2 | 2/2004 | Murray et al. | |
| 6,732,806 | B2 | 5/2004 | Mauldin et al. | |
| 6,820,690 | B2 | 11/2004 | Vercaemer et al. | |
| 6,877,567 | B2 | 4/2005 | Hirth | |
| 6,997,266 | B2 | 2/2006 | Jackson et al. | |
| 7,011,162 | B2 | 3/2006 | Maguire | |
| 7,028,770 | B2 | 4/2006 | Smith, Jr. et al. | |
| 7,073,583 | B2 | 7/2006 | Anderton et al. | |
| 7,093,656 | B2 | 8/2006 | Maguire | |
| 7,114,573 | B2 | 10/2006 | Hirth et al. | |
| 7,128,162 | B2 | 10/2006 | Quinn | |
| 7,185,701 | B2 | 3/2007 | Mackenzie | |
| 7,225,870 | B2 | 6/2007 | Pedersen et al. | |
| 7,383,889 | B2 | 6/2008 | Ring et al. | |
| 7,503,396 | B2 | 3/2009 | Hester | |
| 7,533,731 | B2 | 5/2009 | Corre et al. | |
| 7,699,113 | B2 | 4/2010 | Ring | |
| 7,992,644 | B2 * | 8/2011 | Giroux | 166/380 |
| 8,069,916 | B2 * | 12/2011 | Giroux et al. | 166/212 |
| 8,522,885 | B2 * | 9/2013 | Giroux et al. | 166/384 |
| 2003/0192705 | A1 * | 10/2003 | Cook et al. | 166/379 |
| 2005/0045342 | A1 | 3/2005 | Luke et al. | |
| 2005/0081358 | A1 | 4/2005 | Cook et al. | |
| 2005/0161226 | A1 * | 7/2005 | Duggan et al. | 166/380 |
| 2005/0217866 | A1 * | 10/2005 | Watson et al. | 166/384 |
| 2005/0236162 | A1 | 10/2005 | Badrak et al. | |
| 2006/0124295 | A1 | 6/2006 | Maguire | |
| 2006/0243444 | A1 * | 11/2006 | Brisco et al. | 166/298 |
| 2007/0144784 | A1 * | 6/2007 | Head et al. | 175/57 |
| 2007/0187113 | A1 | 8/2007 | Hester | |
| 2008/0099210 | A1 | 5/2008 | Gazewood | |
| 2008/0142213 | A1 | 6/2008 | Costa et al. | |
| 2008/0156499 | A1 * | 7/2008 | Giroux et al. | 166/380 |
| 2009/0014172 | A1 | 1/2009 | Costa et al. | |
| 2009/0151930 | A1 * | 6/2009 | Giroux | 166/207 |
| 2010/0243277 | A1 | 9/2010 | Ring | |
| 2010/0252252 | A1 | 10/2010 | Harris et al. | |

OTHER PUBLICATIONS

Australian Patent Examination Report dated Jun. 5, 2013, for Australian Application No. 2011205189.

* cited by examiner

ANCHOR FOR USE WITH EXPANDABLE TUBULAR

CROSS-REFERENCE TO RELATED APPLICATIONS

This application claims benefit of U.S. Prov. Pat. App. No. 61/371,082, filed Aug. 5, 2010, which is herein incorporated by reference in its entirety.

BACKGROUND OF THE INVENTION

1. Field of the Invention

Embodiments of the present invention generally relate to an anchor for use with an expandable tubular.

2. Description of the Related Art

In the drilling of oil and gas wells, a wellbore is formed using a drill bit disposed at a lower end of a drill string that is urged downwardly into the earth. After drilling to a predetermined depth or when circumstances dictate, the drill string and bit are removed and the wellbore is lined with a string of casing. An annulus is thereby formed between the string of casing and the formation. A cementing operation is then conducted in order to fill the annular area with cement. The combination of cement and casing strengthens the wellbore and facilitates the isolation of certain areas or zones behind the casing including those containing hydrocarbons. The drilling operation is typically performed in stages and a number of casing or liner strings may be run into the wellbore until the wellbore is at the desired depth and location.

The casing may become damaged over time due to corrosion, perforating operations, splitting, collar leaks, thread damage, or other damage. The damage may be to the extent that the casing no longer isolates the zone on the outside of the damaged portion. The damaged portion may cause significant damage to production fluid in the zones or inside the casing as downhole operations are performed. To repair the damaged portion, an expandable tubular patch may be run into the wellbore with an expansion cone. An anchor temporarily secures the patch to the casing. The expansion cone is then pulled through the patch using a hydraulic jack at the top of the patch. The hydraulic jack pulls the expansion cone through the patch and into engagement with the damaged casing. Thus, the patch covers and seals the damaged portion of the casing.

The hydraulic jack is limited in the amount of force it can apply to the expansion cone. Typical hydraulic jacks are limited to 35,000 kilopascal (kPa) applied to the work string. This limits the amount of expansion force applied to the expansion cone and thereby the patch. Further, the hydraulic jack requires a high pressure pump to operate which adds to the cost of the operation. Moreover, the work string must be sealed so pump pressure can be applied to operate the hydraulic jack which makes it difficult to pump fluid down to the expansion cone in order to lubricate the cone during expansion. Still further, the hydraulic jack has a very small and limited stroke. Thus, in order to expand a long patch, the hydraulic jack may need to be reset a number of times to at least anchor the patch to the casing.

Therefore, there exists a need for a mechanical expansion system capable of expanding a tubular with an increased force for an increased distance.

SUMMARY OF THE INVENTION

Embodiments of the present invention generally relate to an anchor for use with an expandable tubular. In one embodiment, a method of lining a wellbore includes deploying a BHA into the wellbore using a conveyance. The BHA includes setting tool, an anchor, and an expandable tubular. The method further includes pressurizing a bore of the setting tool, thereby releasing the anchor from the setting tool. The method further includes pulling the conveyance, thereby: extending the anchor into engagement with a casing of the wellbore, pulling an expander of the setting tool through the expandable tubular, and expanding the tubular into engagement with an open and/or cased portion of the wellbore and retracting the anchor.

In another embodiment, an anchor for use in a wellbore includes: a tubular drag operable to engage a casing of the wellbore; a tubular slip retainer connected to the drag and having flanged portions; slips, each slip having a flanged portion for mating with a respective retainer flanged portion and an inclined portion having an inner surface and a profile; and a tubular slip body having pockets, each pocket having an inclined outer surface and a profile and for mating with a respective slip inclined portion. The flanged portions are each inclined. The flanged portions, pockets, and inclined portions are operable to radially extend the slips in response to relative longitudinal movement of the slip body toward the slip retainer. The flanged portions, pockets, and inclined portions are operable to radially retract the slips in response to relative longitudinal movement of the slip retainer away from the slip body.

BRIEF DESCRIPTION OF THE DRAWINGS

So that the manner in which the above recited features described herein can be understood in detail, a more particular description of embodiments, briefly summarized above, may be had by reference to embodiments, some of which are illustrated in the appended drawings. It is to be noted, however, that the appended drawings illustrate only typical embodiments described herein and are therefore not to be considered limiting of its scope, for the invention may admit to other equally effective embodiments.

DETAILED DESCRIPTION

Figure 1:
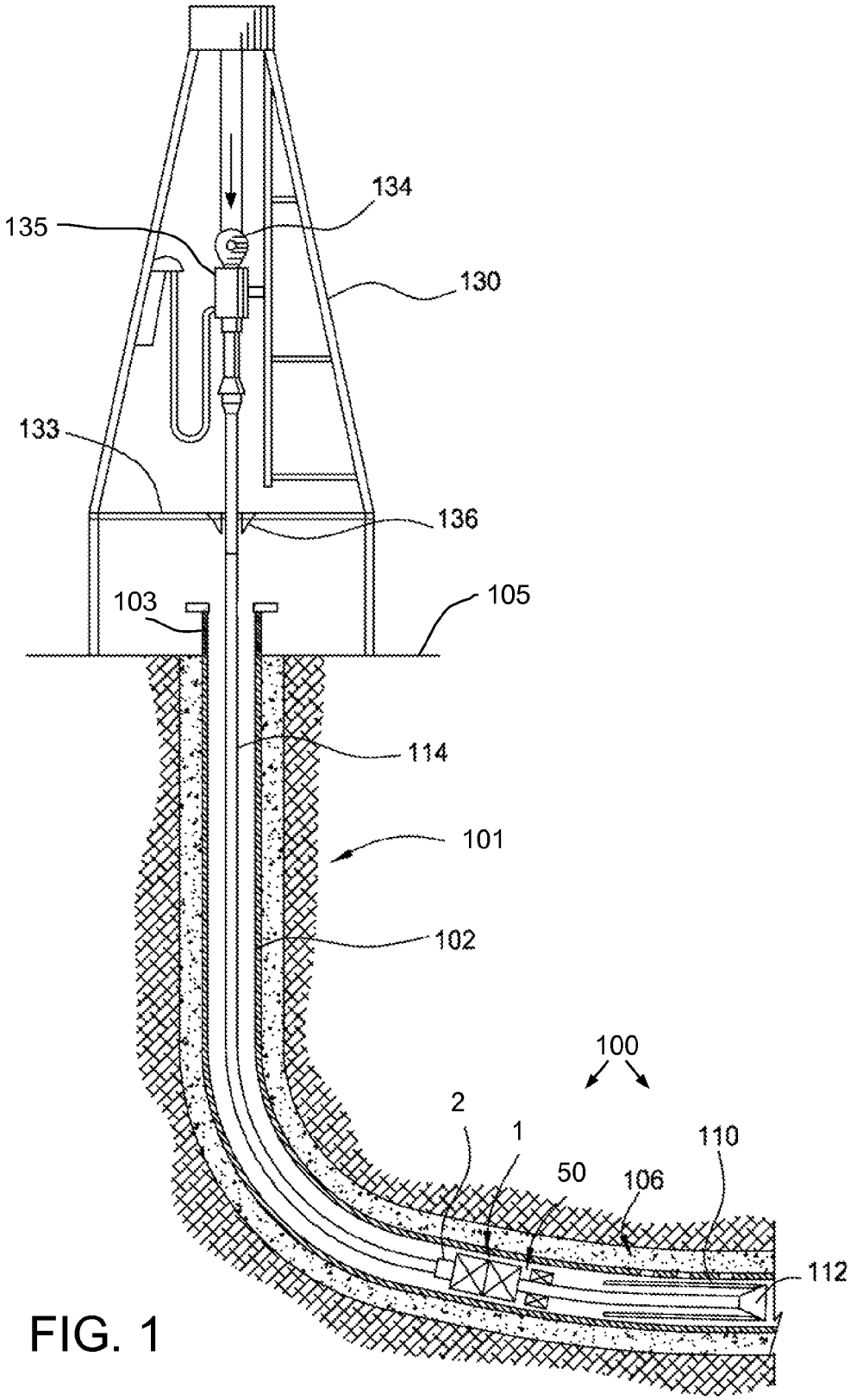
FIG. 1 illustrates a bottom hole assembly (BHA) deployed to a damaged portion of casing, according to one embodiment of the present invention.
Figure 2A:
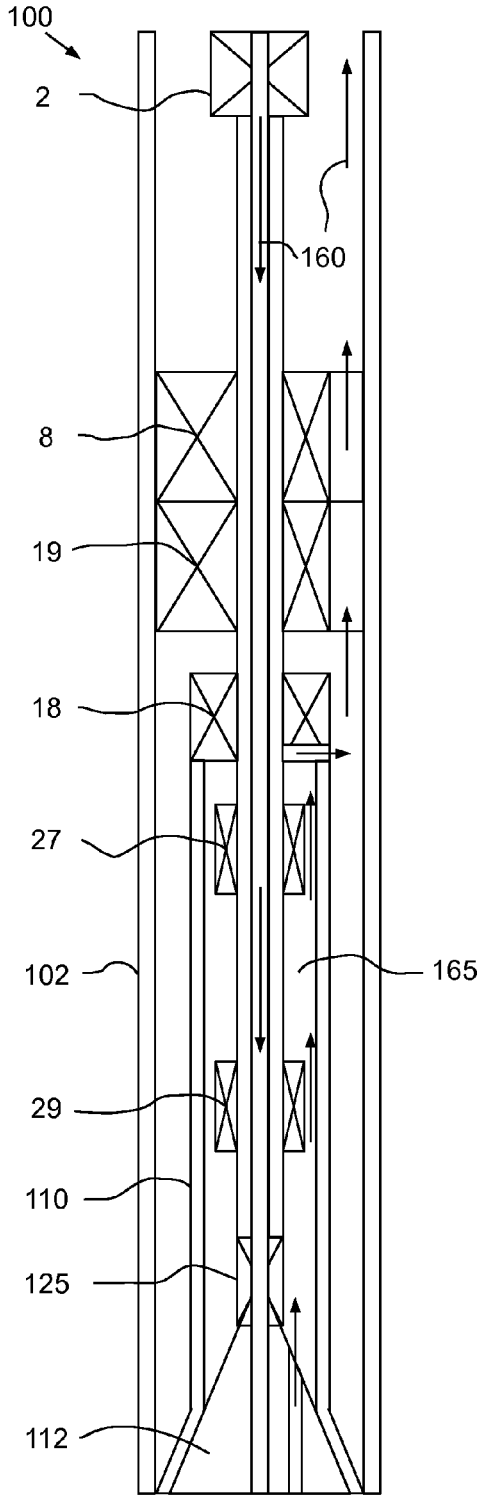
FIG. 2A illustrates operation of the BHA.

FIG. 1 illustrates a bottom hole assembly (BHA) 100 deployed to a damaged portion 106 of casing 102, according to one embodiment of the present invention. FIG. 2A illustrates operation of the BHA 100. A wellbore 101 may include the casing 102 cemented into place and extending from a wellhead 103 located at a surface 105 of the earth. The casing 102 may include the damaged portion 106. The BHA 100 may be adapted to repair the damaged portion 106 of the casing 102. The damaged portion 106 of the casing 102 may be caused by a perforation operation; however, it should be appreciated that the damaged portion 106 may be the result of any damage to the casing 102 including, but not limited to, corrosion, thread damage, collar damage, damage caused by cave-in, and/or damage caused by earthquakes. The BHA 100 may include an anchor 1, a setting tool 50 and an expandable tubular, such as a casing patch 110. The setting tool 50 may include a work string and an expander 112. The BHA 100 may be longitudinally and torsionally connected to a conveyance 114 which allows the BHA 100 to be conveyed into a wellbore and manipulated downhole from the surface 105. Alternatively, the wellbore 101 may be subsea and the wellhead 103 may be at seafloor or waterline.

The BHA 100 may be deployed into the wellbore 101 using the conveyance 114 until it reaches a desired location, such as adjacent the damaged portion 106. The anchor 1 may then be operated in order to engage the casing 102. With the anchor 1 engaged to the casing 102, the conveyance 114 may be pulled up using a hoist 134 and thereby pull the expander 112 through the patch 110. The conveyance 114 may transfer torque, tensile forces and compression forces to the expander 112. Lubricant 160, such as drilling fluid or mineral oil, may be pumped down the conveyance 114 during the expansion in order to lubricate the expander 112. The conveyance 114 may pull the expander 112 through the patch 110 until the entire patch 110 is engaged with an inner surface of the casing 102. The setting tool 50 and anchor 1 may then be removed from the wellbore 101 leaving the damaged portion 106 of the casing 102 repaired.

The conveyance 114 may be used to convey and manipulate the BHA 100 in the wellbore 101. The conveyance 114 may be a string of drill pipe including several joints fastened together, such as by threaded connections. Alternatively, the conveyance may be coiled tubing or continuous sucker rod. The expander 112 may include a mandrel which may be threaded to a cone. A suitable expander may be discussed and illustrated in U.S. Patent App. Publication Number US2007/0187113 which is herein incorporated by reference in its entirety. The expander 112 may be longitudinally connected to the patch 110, such as by a threaded connection, in order to secure the patch 110 to the setting tool during deployment. The expander mandrel may include one or more lubricant ports located around the circumference thereof for discharging lubricant from the conveyance. The lubricant may flow between the patch 110 and the expander cone. The expander cone may include a flared portion capable of plastically and radially deforming the patch 110 into engagement with the casing 102. The expander cone may be pulled through the patch 110 by the hoist 134 pulling the conveyance 114 and the setting tool work string.

Alternatively, the expander 112 may be a compliant or collapsible cone. Alternatively, the expander 112 may be a rotary expander. Alternatively, the expander 112 may be an inflatable bladder. Should the expander become stuck in the tubular, the setting tool may further include a releasable latch 125 connecting the expander 112 to the setting tool 1 and the latch may be released, thereby freeing the anchor from the expander.

An upper end of the conveyance 114 may be supported from a drilling rig 130 by a gripping member 136 located on a rig floor 133 and/or by a hoist 134. Alternatively, a workover rig or a subbing unit may be used instead of the drilling rig 130. The gripping member 136 may include set of slips and a bowl; capable of supporting the weight of the conveyance 114 and the BHA 100 from the rig floor 133. The hoist 134 may be operable to lower and raise the conveyance 114 and thereby the BHA 100 into and out of the wellbore 101. Further, the hoist 134 may provide the pulling force required to move the expander 112 through the patch 110 during the expansion operation. The hoist 134 may include drawworks, a crown block, and a traveling block. Alternatively, the hoist may include an injector or a surface jack. A top drive 135 may connect the hoist 134 to the conveyance 114, may be operable to rotate the conveyance, and may conduct the lubricant 160 from a rig pump (not shown) into the conveyance 114 via a standpipe (not shown) and a hose. Alternatively, a Kelly, rotary table, and Kelly swivel may be used to rotate and deliver lubricant 160 to the conveyance 114 instead of the top drive 135.

Figures 3A, 3B, 3C:
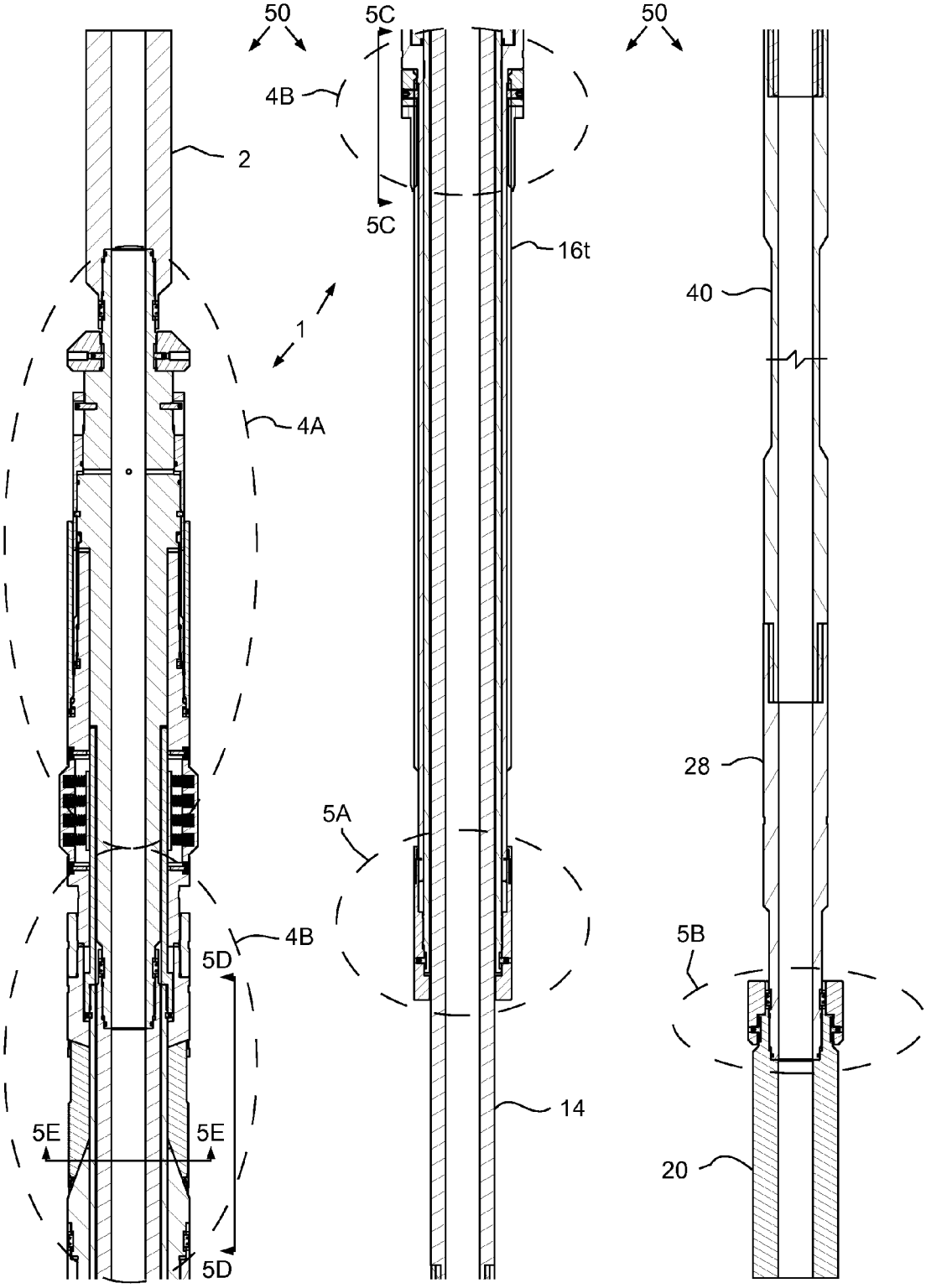
FIGS. 3A-3C illustrates an anchor and a work string of a setting tool of the BHA.
Figure 4A:
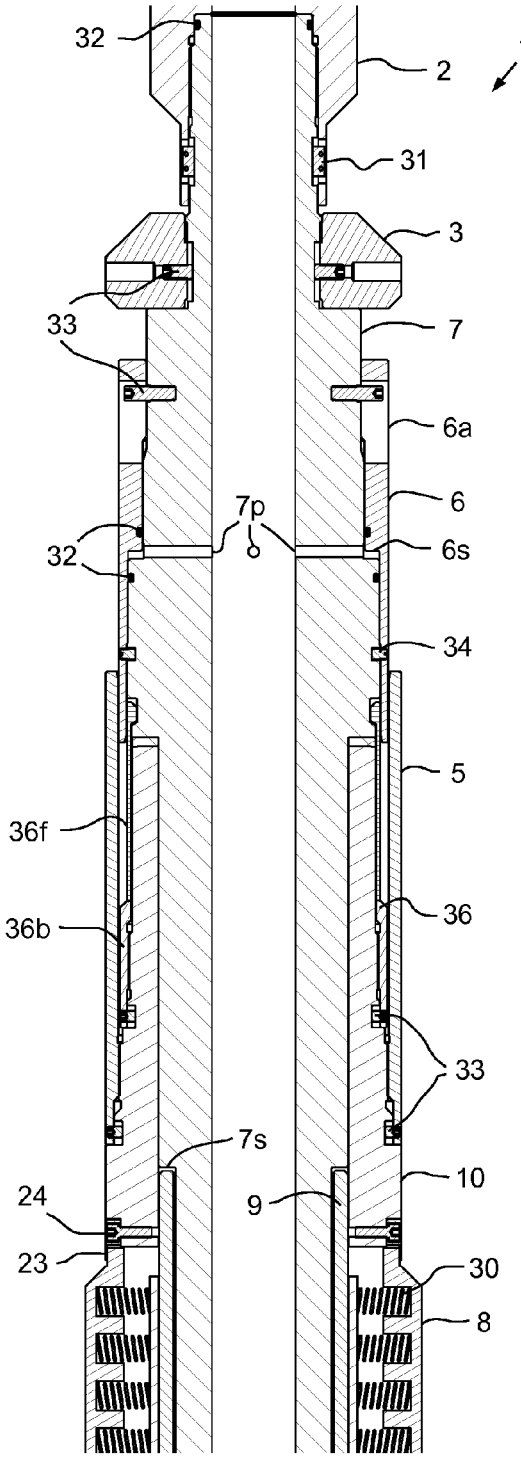
FIGS. 4A and 4B are enlargements of portions of FIGS. 3A and 3B illustrating the anchor.
Figure 4B:
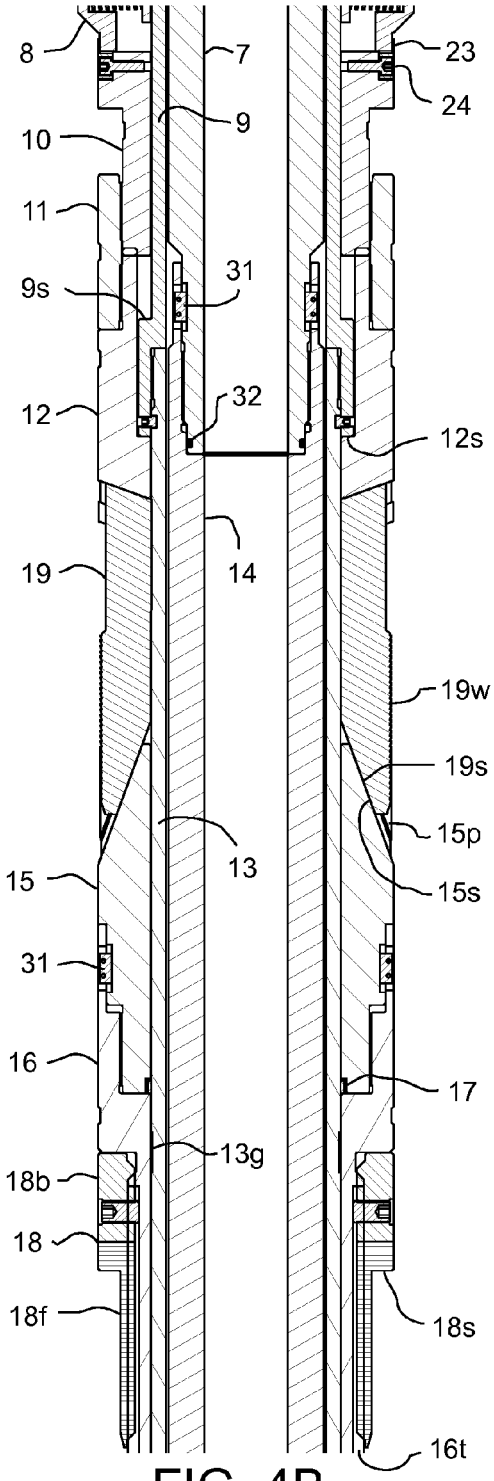
Figure 5A:
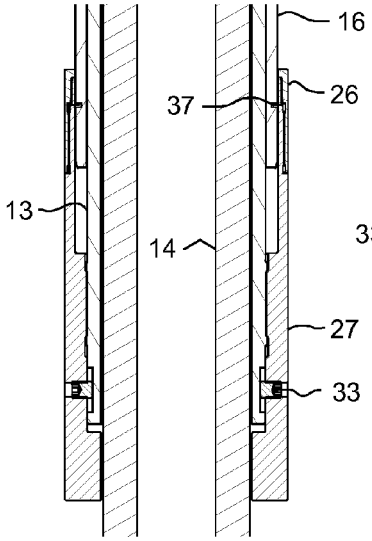
FIG. 5A is an enlargement of another portion of FIG. 3B.
Figure 5B:
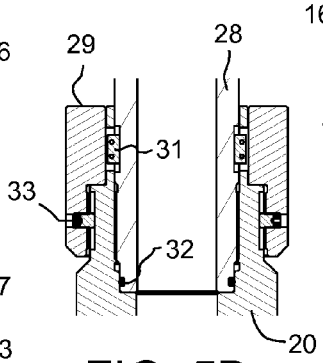
FIG. 5B is an enlargement of a portion of FIG. 3C.
Figure 5C:
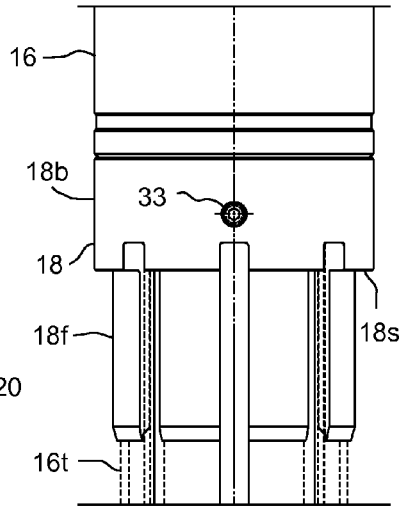
FIG. 5C illustrates a liner stop of the anchor.
Figure 5D:
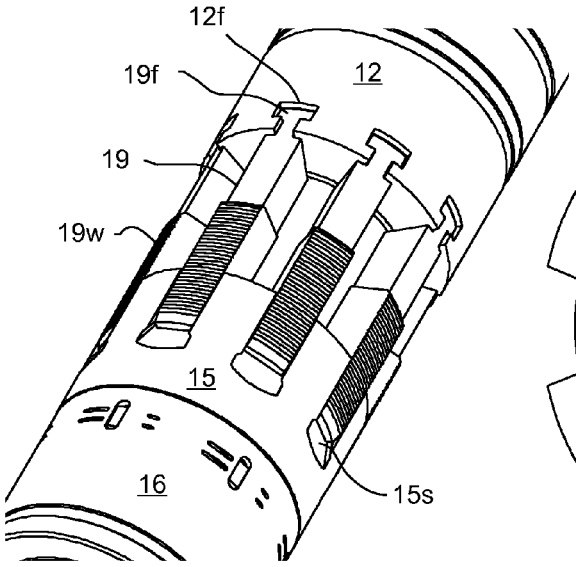
FIGS. 5D and 5E illustrate slips of the anchor.
Figure 5E:
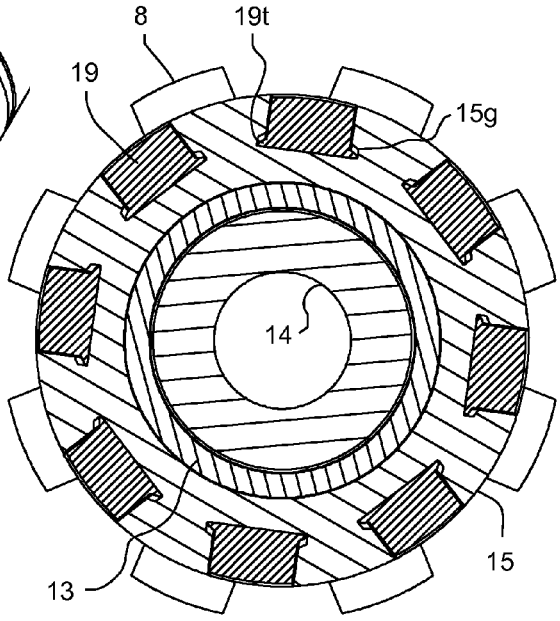

FIGS. 3A-3C illustrate the anchor 1 and a work string of the setting tool 50. FIGS. 4A and 4B are enlargements of portions of FIGS. 3A and 3B illustrating the anchor 1. FIG. 5A is an enlargement of another portion of FIG. 3B. FIG. 5B is an enlargement of a portion of FIG. 3C. FIG. 5C illustrates a liner stop 18 of the anchor 1. FIGS. 5D and 5E illustrate slips 19 of the anchor 1.

The setting tool work string may include a tubular top sub 2 having a threaded (not shown) upper end for connection to the conveyance 114 and may be longitudinally and torsionally connected to a tubular port mandrel 7, such as by a threaded connection and fasteners, such as keys 31 and pins. One or more seals, such as an o-ring 32 may be disposed between the top sub 2 and the port mandrel 7. A piston stop 3 may be longitudinally and torsionally connected to the port mandrel 7, such as by a threaded connection and one or more fasteners, such as set screws 33. An upper tubular adapter 14 may be longitudinally and torsionally connected to the port mandrel 7, such as by a threaded connection and fasteners, such as keys 31 and pins. One or more seals, such as an o-ring 32 may be disposed between the port mandrel 7 and the upper adapter 14.

The setting tool work string may further include a spacer 40 longitudinally and torsionally connected to the upper adapter 14, such as by a threaded connection. A length of the spacer 40 may correspond to a length of the casing patch 110. The spacer 40 may include one or more tubular joints, such as drill pipe. Alternatively, the expandable tubular may be an expandable liner 210 (see FIG. 2B) instead of the casing patch 110 and the liner may be used to line an open hole section of the wellbore 101, such as adjacent to a productive formation. The length of the spacer 40 may then be substantial, such as greater than or equal to one thousand feet. In this alternative, an upper portion of the liner 210 may be engaged with a lower portion of the casing 102 to serve as a liner hanger.

The anchor 1 may include a drag having a drag case 10 longitudinally and torsionally connected to the port mandrel 7 (during deployment), such as by a castellation joint and a latch, such as a collet 36. The collet 36 may be disposed around the drag case 10 and connected thereto, such as by a threaded connection and one or more fasteners, such as set screws 33. The collet 36 may include a (solid) base 36*b* and a plurality of split fingers 36*f* extending longitudinally from the base. The fingers 36*f* may have lugs formed at an end distal from the base. The lugs may be received by a latch profile, such as a groove, formed in an outer surface of the port mandrel 7.

Figures 8A, 8B, 8C, 8D:
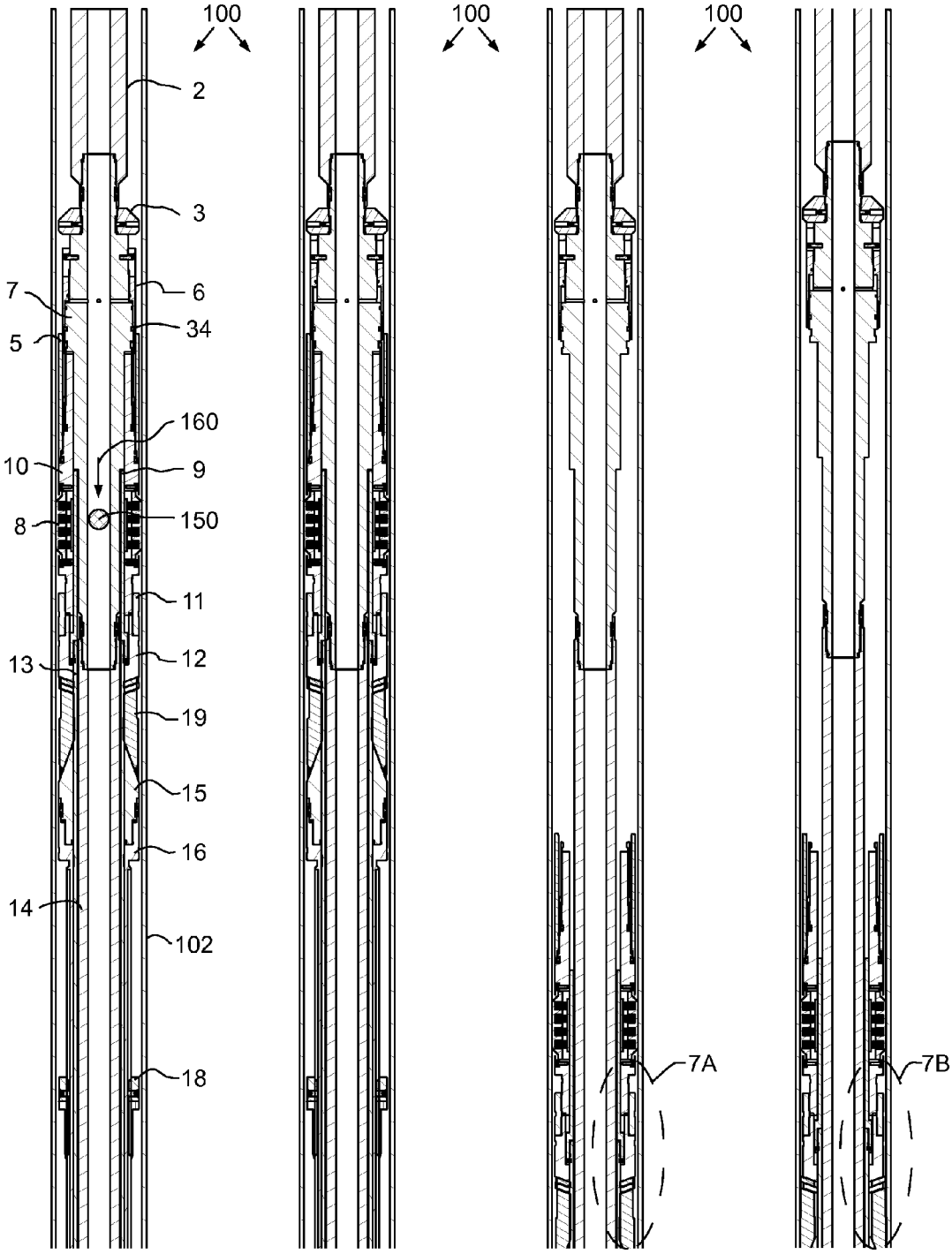
FIGS. 8A-8H illustrate operation of an upper portion of the BHA.
Figure 8E:
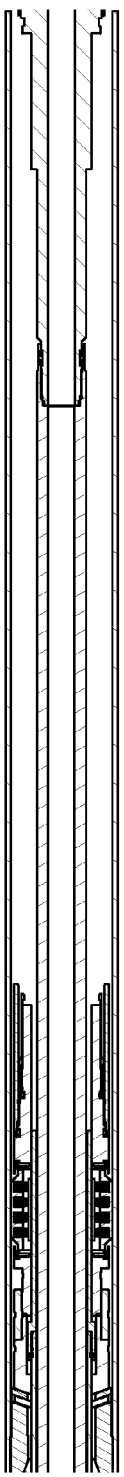

The setting tool work string may further include a tubular piston 6 disposed around and along the port mandrel 7. The piston 6 may be longitudinally movable relative to the port mandrel 7 between a locked position (shown) and an unlocked position (FIG. 8B). The piston 6 may have upper and lower portions defined by a shoulder 6*s*. The upper portion may have one or more slots 6*a* formed therethrough. A fastener, such as a set screw 33, may be disposed in each slot 6*a* and connected to the port mandrel 7, thereby torsionally connecting the piston 6 and the mandrel while allowing longitudinal movement therebetween. In the locked position, the piston lower portion may engage the collet finger lugs, thereby locking the lugs in the port mandrel groove. One or more ports 7*p* may be formed through a wall of the mandrel 7. A piston chamber may be formed between the piston shoulder 6*s* and a corresponding shoulder formed in an outer surface of the port mandrel 7. A pair of seals, such as o-rings 32, may be disposed between the piston 6 and the port mandrel 7 and may straddle the piston chamber. During deployment of the anchor 1, the piston may be longitudinally connected to the port mandrel 7 in the locked position by one or more frangible fasteners, such as shear screws 34.

The anchor 1 may further include a latch case 5 longitudinally and torsionally connected with the drag case 10, such as by a threaded connection and one or more fasteners, such as set screws 33. The drag case 10 may house drag blocks 8. The drag blocks 8 may be operable to engage an inner surface of the casing 102 in order to provide a resistive force. Alternatively, leaf springs may be used instead of the drag blocks 8. Each drag block 8 may be radially movable relative to the drag case 10 and extend from a cavity formed in the drag case 10. Each drag block 8 may be radially biased away from the drag case 10 by a biasing member, such as one or more springs (i.e., coil) 30. Each drag block 8 may have upper and lower tabs formed at a top and bottom thereof. Each tab may engage a keeper 23 when each drag block 8 is extended, thereby stopping extension of the drag block. Each drag block 8 may be longitudinally connected to the drag case 10 by engagement of the tabs with a surface of the drag case. Each keeper 23 may be fastened to the drag case 10, such as by one or more cap screws 24.

The drag case 10 may be longitudinally and torsionally connected to a tubular slip retainer 12, such as by a threaded nut 11 and a castellation joint. The slip retainer 12 may be longitudinally and torsionally coupled to upper portions of each of two or more slips 19, such as by a flanged (i.e., T-flange 19*f* and T-slot 12*f*) connection 12*f*, 19*f*. Each flanged connection 12*f*, 19*f* may have inclined ϕ (FIG. 6C) surfaces to facilitate extension and retraction of the slips 19. Each slip 19 may be radially movable between an extended position and a retracted position by longitudinal movement of a tubular slip body 15 relative to the slips 19. The slip body 15 may have a pocket 15*p* formed in an outer surface thereof for receiving a lower portion of each slip 19. The slip body 15 may be torsionally connected to lower portions of the slips 19 by reception thereof in the pockets. Each slip pocket 15*p* may have an inclined surface 15*s* for extending a respective slip 19. A lower portion of each slip 19 may have an inclined inner surface 19*s* corresponding to the slip pocket surface 15*s*.

Longitudinal movement of the slip body 15 toward the slips 19 along the inclined surfaces 15*s*, 19*s* may wedge the lower portions of the slips toward the extended position and resultant longitudinal movement of the upper portions of the slips relative to the slip retainer 12 may wedge the upper portions of the slips toward the extended position. The lower portion of each slip 19 may also have a guide profile, such as tabs 19*t*, extending from sides thereof. Each slip pocket may also have a mating guide profile, such as grooves 15*g*, for retracting the slips 19 when the slip retainer 12 moves longitudinally relative to and away from the slips. Further, the tab-groove 19*t*, 15*g* connection may also longitudinally support the slip body 15 from the slips 19 due to abutment of inner surfaces of the slips 19 with an outer surface of the lower release mandrel 13. Each slip 19 may have teeth 19*w* formed along an outer surface thereof. The teeth 19*w* may be made from a hard material, such as tool steel, ceramic, or cermet for engaging and penetrating an inner surface of the casing 102, thereby anchoring the slips 19 to the casing 102.

Figures 9A, 9B, 9C, 9D:
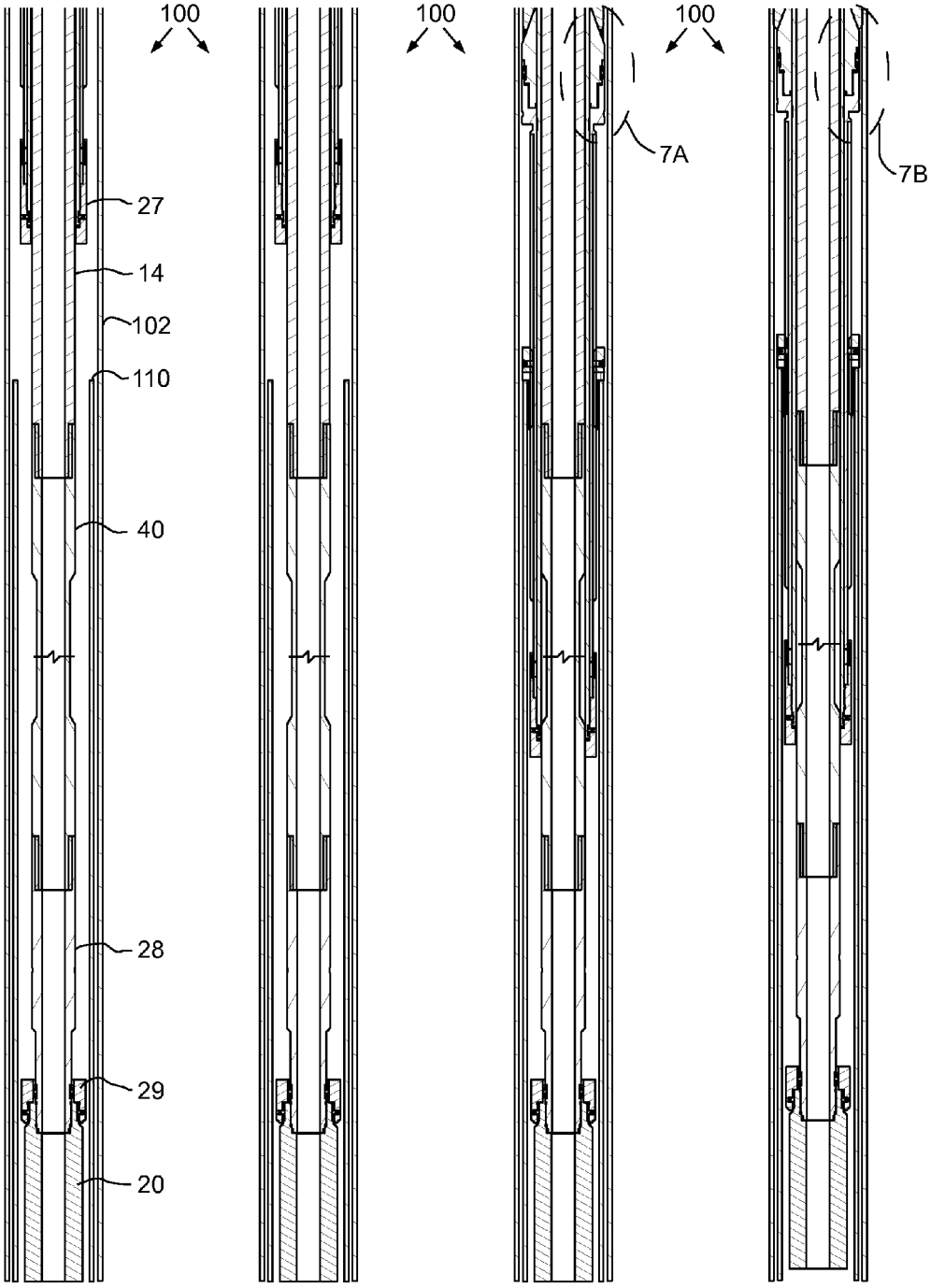
FIGS. 9A-9H illustrate operation of a lower portion of the BHA corresponding to FIGS. 8A-8H, respectively.
Figure 9E:
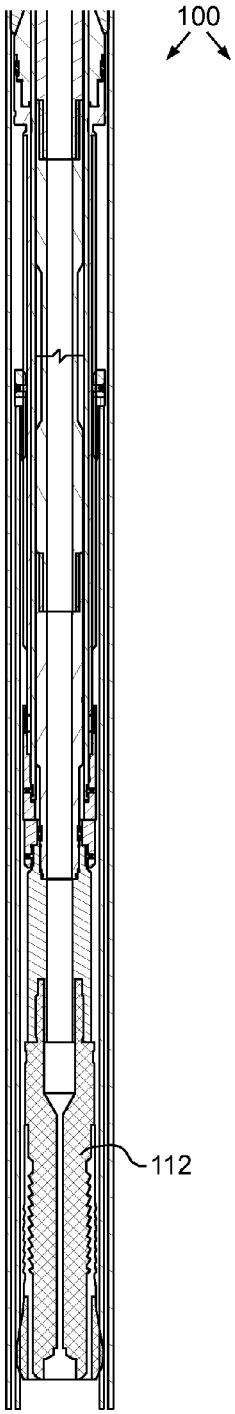

A tubular retainer case 16 may be longitudinally and torsionally connected to the slip body 15 such as by a threaded connection and fasteners, such as keys 31 and pins. The retainer case 16 may have a threaded outer surface 16*t* extending therealong. A liner stop, such as a nut 18, may be disposed along the threaded outer surface 16*t*. A position of the liner stop 18 may be adjusted along the retainer case 16 by rotating the liner stop and then the liner stop 18 may be locked into place, such as by one or more set screws 33. The liner stop 18 may include a (solid) base 18*b* and a plurality of split fingers 18*f* extending longitudinally from the base. Both an inner surface of the base 18*b* and the fingers 18*f* may be threaded. The fingers 18*f* may have shoulders 18*s* formed at an end proximate to the base 18*b*. The shoulders 18*s* may be configured to abut a top of the patch 110 (FIG. 9C) and slots formed between the fingers 18*f* may serve as a part of a return flow path 165 (discussed below). During deployment of the anchor 1, the liner stop 18 may be adjusted so that there is a substantial distance between the liner stop and the top of the patch 110 (FIGS. 8A and 9A). Alternatively, the liner stop 18 may be engaged with or proximate to a top of the patch 110 for deployment.

The anchor 1 may further include a fastener, such as a snap ring 17, disposed in a groove formed in an inner surface of the slip body 15 at a bottom of the slip body. The snap ring 17 may be radially biased into engagement with an outer surface of the lower release mandrel 13. The snap ring 17 may be longitudinally connected to the slip body 15 and the retainer case 16 by being captured therebetween. A groove 13*g* may be formed in an outer surface of the lower release mandrel 13 for receiving an inner portion of the snap ring 17. The groove 13*g* may have a length greater than a length of the snap ring 17 and less than a setting length of the slips 19 such that once engaged with the groove, the snap ring may engage an upper or lower end of the groove, thereby longitudinally connecting the lower release mandrel 13 and the slip body 15/retainer case 16 before resetting of the slips 19. The snap ring 17 and groove 13*g* may be a failsafe to resetting of the slips 19 during retrieval of the setting tool 50 and anchor 1 to the surface 105.

The anchor 1 may further include a tubular upper release mandrel 9 disposed radially between the port mandrel 7 and the drag case 10 (during deployment) and longitudinally between a shoulder 7*s* formed in an outer surface of the port mandrel 7 and a shoulder 12*s* formed in an inner surface of the slip retainer 12. A bottom of the upper release mandrel 9 may be engaged with the slip retainer shoulder 12*s* to longitudinally support the upper release mandrel from the slip retainer 12. The upper release mandrel 9 may have a shoulder 9*s* formed in an outer surface thereof and spaced longitudinally from a bottom of the drag case 10 by a distance sufficient to allow extension of the slips 19 (see FIG. 7B). A lower tubular release mandrel 13 may be disposed radially between the upper adapter 14 and slip retainer 12, slips 19, slip body 15, retainer case 16, and a release sleeve 27 and longitudinally between a shoulder formed in an inner surface of the upper retainer mandrel 9 and a shoulder formed in an inner surface of the release sleeve 27. The release sleeve 27 may be longitudinally and torsionally connected to the lower release mandrel 13, such as by a threaded connection and one or more fasteners, such as set screws 33. A shear case 26 may be longitudinally and torsionally connected to the release sleeve 27, such as by a threaded connection. A frangible fastener, such as a shear ring 37, may be captured between a shoulder formed in an inner surface of the shear case 26 and a top of the release sleeve 27. The shear ring 37 may extend into a groove formed in an outer surface of the retainer case 16, thereby longitudinally connecting the lower release mandrel 13 and the retainer case. The retainer case groove may include a longitudinal clearance below the shear ring 37 so that the shear ring does not support weight of the retainer case 16.

The setting tool work string may further include a lower adapter 28 longitudinally and torsionally connected to a lower end of the spacer 40, such as by a threaded connection. A bottom sub 20 may be longitudinally and torsionally connected to the lower adapter 28, such as by such as by a threaded connection and fasteners, such as keys 31 and pins. The bottom sub 20 may also have a threaded coupling for connecting to other components of the setting tool 50, such as the expander 112. A release trigger, such as a nut 29, may be longitudinally and torsionally connected to the bottom sub 20, such as by a threaded connection and one or more fasteners, such as set screws 33.

Figure 6A:
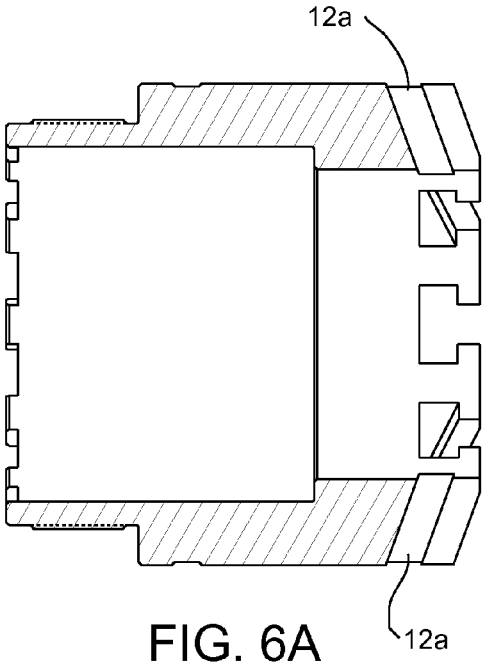
FIGS. 6A-6C illustrate a slip retainer of the anchor.
Figure 6B:
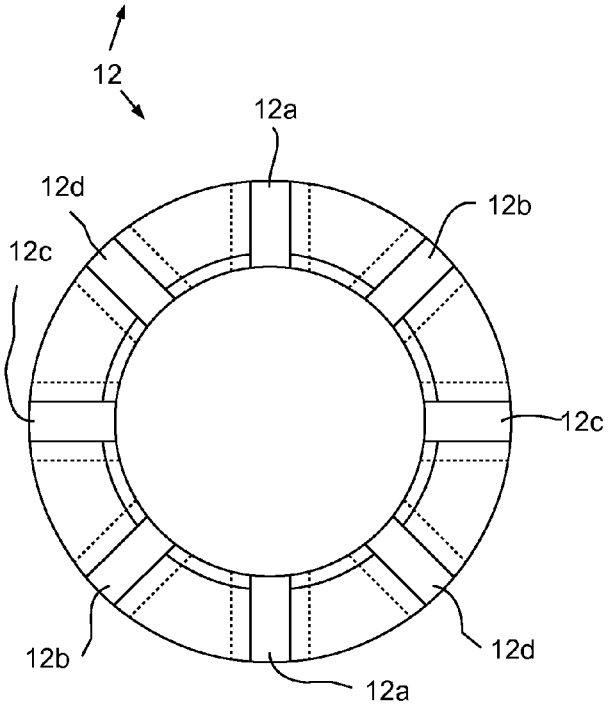
Figure 6C:
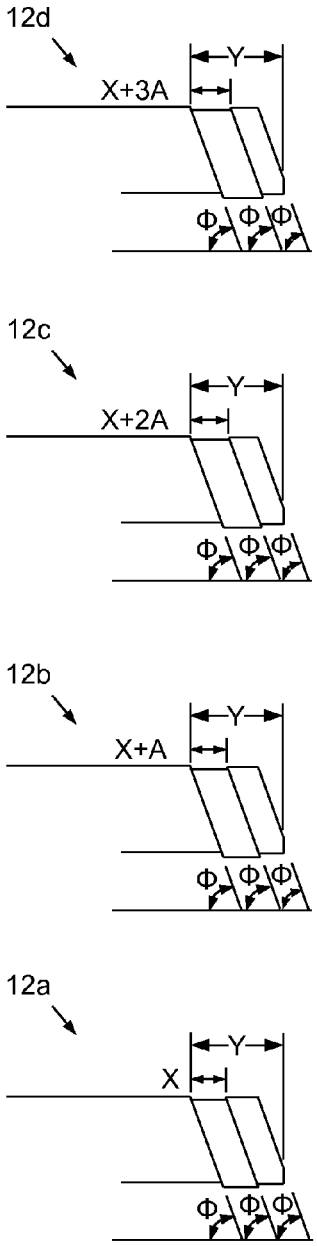

FIGS. 6A-6C illustrate the slip retainer 12. To facilitate release of the slips 19 from the casing 102, the slip retainer 12 may include one or more pairs 12*a-d* of flanges 12*f*. The pairs 12*a-d* may be opposing. A first pair 12*a* of flanges 12*f* may be made to fit with the corresponding slip flange 19*f* and may have a slot length having a longitudinally intersected dimension X (slot length equal to X multiplied by sin(ϕ))). For reference, an overall flange length Y is shown is from a top of each pair 12*a-d* of flanges 12*a-d* to a bottom of the slip retainer 12. A slot length of a second pair 12*b* of flanges 12*f* may be greater than the slot length of the first pair 12*a* of flanges 12*f* by a clearance having a longitudinally intersected dimension A (clearance length equal to A multiplied by sin (ϕ))). A slot length of a third pair 12*c* of flanges 12*f* may be greater than the slot length of the first pair 12*a* of flanges 12*f* by a clearance having a longitudinally intersected dimension 2A. A slot length of a fourth pair 12*d* of flanges 12*f* may be greater than the slot length of the first pair 12*a* of flanges 12*f* by a clearance having a longitudinally intersected dimension 3A. The slip flanges 19*f* may all be identical.

Enlargement of the subsequent pairs 12*b-d* of flanges 12*f* may stagger release of the slips 19 such that as a releasing force is exerted on the slips (by pulling of the slip retainer 12 longitudinally away from the slips), the releasing force may be exerted individually on each respective pair of the slips instead of being divided among all of the slips, thereby reducing the amount of force required to release the slips and reducing jarring of the anchor 1 when the slips release. The release force may initially be exerted on a first pair of slips 19 (corresponding to the first pair 12*a* of flanges 12*f*) and once the first pair of slips releases from the casing 102, the release force may then be exerted on the second pair of slips after the slip retainer 12 has traveled longitudinally upward the distance A and so on. The dimension 3A may be substantially less than an extension/retraction distance of the slips such that the first pair of slips may continue to retract during release of the subsequent pairs of slips. For brevity, this staggered release of the slips 19 will hereinafter be referred to as unzipping.

To assemble the slips 19 with the rest of the anchor 1 (not shown, see FIG. 7D of the '082 provisional), the slip retainer 12 and the slip body 15 may be moved into proximity with each other and the slips inserted radially into the respective pockets 15*p* and flanges 12*f*.

Figure 7A:
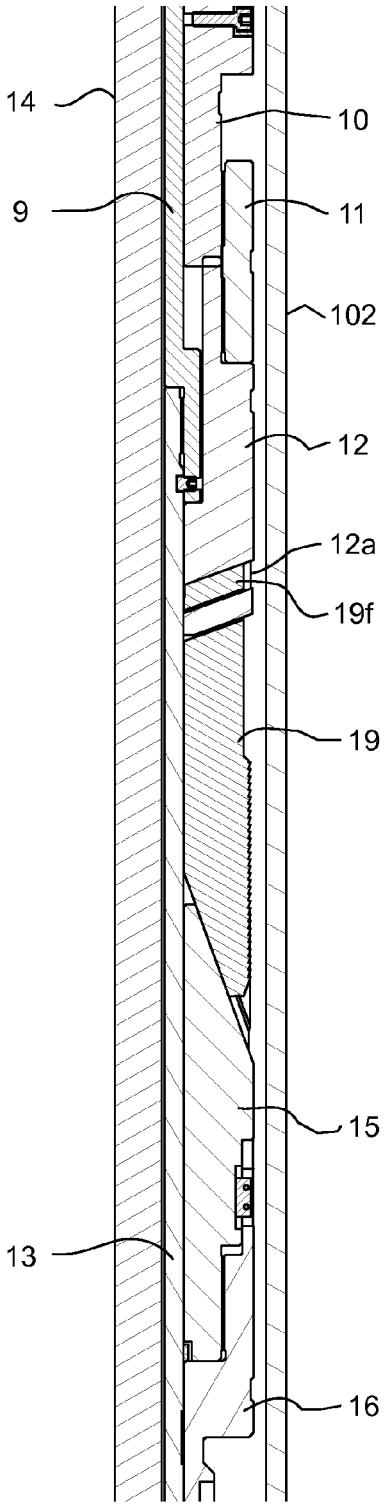
FIGS. 7A-7C are enlargements of portions of FIGS. 8C and 9C, 8D and 9D, and 8G and 9G, respectively, illustrating operation of the slips.
Figure 7B:
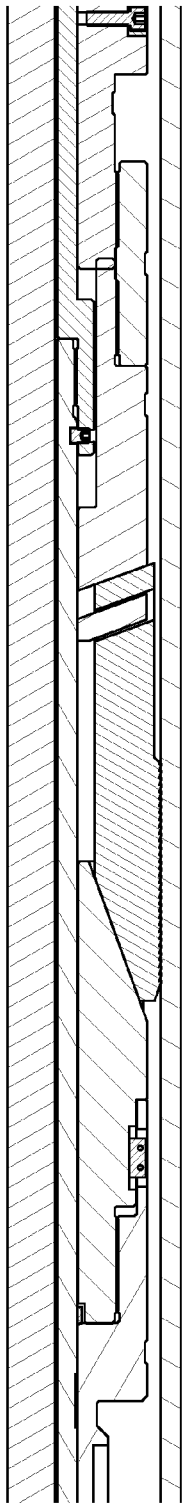
Figure 7C:
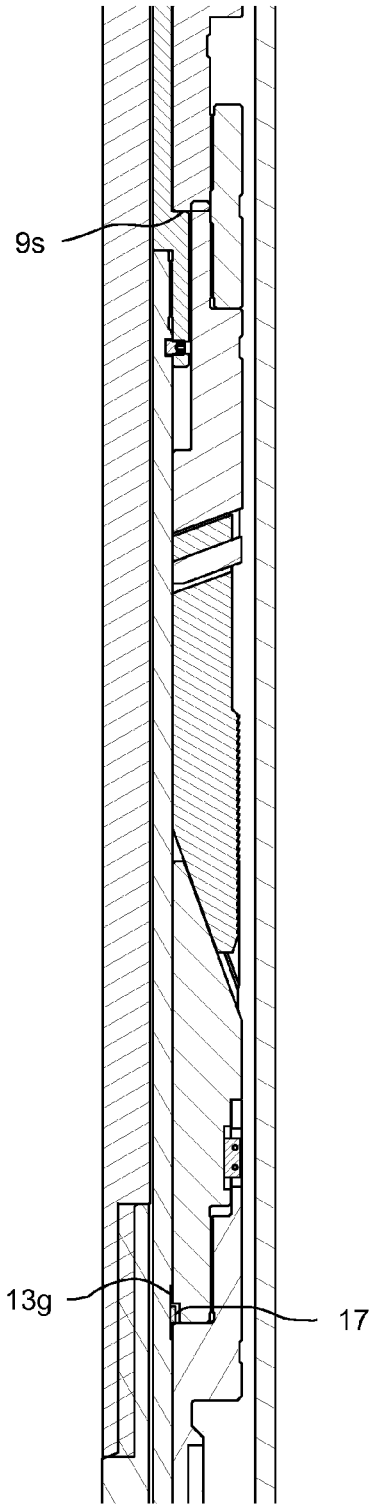

FIGS. 7A-7C are enlargements of portions of FIGS. 8C and 9C, 8D and 9D, and 8G and 9G, respectively, illustrating operation of the slips 19. FIGS. 8A-8H illustrate operation of an upper portion of the BHA 100. FIGS. 9A-9H illustrate operation of a lower portion of the BHA 100 corresponding to FIGS. 8A-8H, respectively. To better illustrate the slip operation, the cross sections have been offset from a center of the slips 19.

In operation, the BHA 100 may be deployed (FIGS. 8A and 9A) into the wellbore 101 using the conveyance 114. Once the BHA 100 has reached the desired location, such as adjacent the damaged portion 106 or an open hole section of the wellbore 101 adjacent a productive formation, the anchor 1 may be released from the setting tool 50. A deformable blocking member, such as a ball 150 or dart, may be pumped through the conveyance 114 using lubricant 160 and land on a seat (not shown) of the setting tool. Alternatively, the ball 150 may be dropped or a bore of the setting tool may be pressurized by pumping of the lubricant 160 through a flow restriction in the setting tool bore (i.e., nozzles of the expander 112) at a flow rate sufficient to generate back pressure in the setting tool bore.

Pumping may then continue, thereby increasing pressure in the port mandrel bore and exerting an upward force on the piston 6 until the shear screws 34 fracture and then moving the piston into engagement with the piston stop 3 (FIGS. 8B and 9B). As the piston 6 moves toward the piston stop 3, the piston may disengage from the collet fingers 36*f*. Weight exerted on the collet fingers 36*f* by the anchor 1 may force the collet fingers 36*f* to disengage from the port mandrel profile. The anchor 1 may then descend longitudinally until the liner stop 18 engages a top of the patch 110 (FIGS. 7A, 8C and 9C). The descent may be slowed by engagement of the drag blocks 8 with the casing 102.

Pumping may continue until the ball 150 deforms and is pushed through the seat. The ball 150 may then be stowed in a ball catcher (not shown). Pressure in the port mandrel bore may be relieved by release of the ball 150 from the seat. The conveyance 114 may then be pulled using the hoist 134, thereby longitudinally pulling the expander 112 and the patch 110 upward against the liner stop 18 which may push the slip body 15 upward against the slips 19, thereby moving the slips upward and outward along the inclined surfaces 15*s* of the pockets 15*p* and the flanges 12*f* until the slips engage the casing 102 (FIGS. 7B, 8D and 9D). The slip retainer 12 may be restrained against upward movement by engagement of the drag blocks 8 with the casing 102. The release mandrels 9, 13 may be carried upward with the liner stop by the shear ring 37. Once the slips 19 have been set, the expander 112 may then be released from the patch 110 and pulling of the conveyance 114 may continue, thereby longitudinally pulling the expander upward through the patch. The patch 110 may be restrained from upward movement by engagement with the liner stop 18, thereby expanding the tubular via compression. Lubricant 160 may be pumped/continued to be pumped during expansion (FIG. 2A). As the patch 110 is expanded into engagement with the casing 102, the expanded portion of the patch may serve as a (lower) anchor, thereby alternating from compressive expansion to tensile expansion. The patch 110 may also longitudinally contract away from the liner stop 18. The slips 19 may or may not remain engaged with the casing 102 as the patch 110 contracts.

Figure 8F:
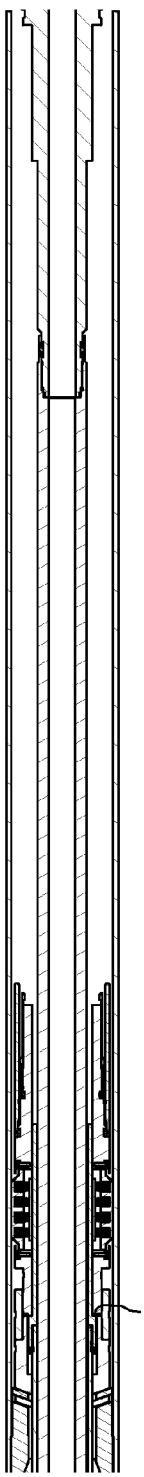
Figure 8G:
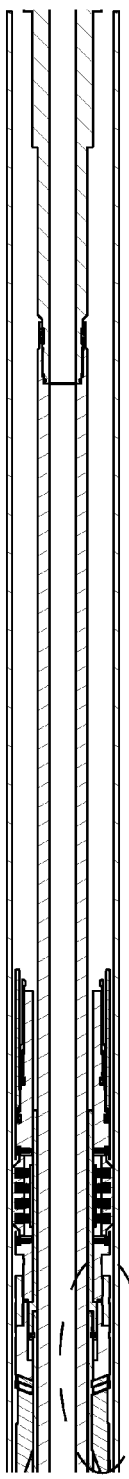
Figure 8H:
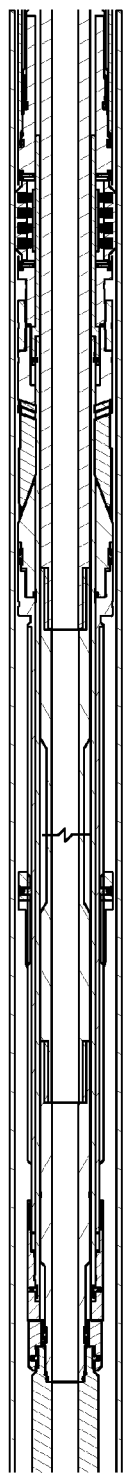
Figure 9F:
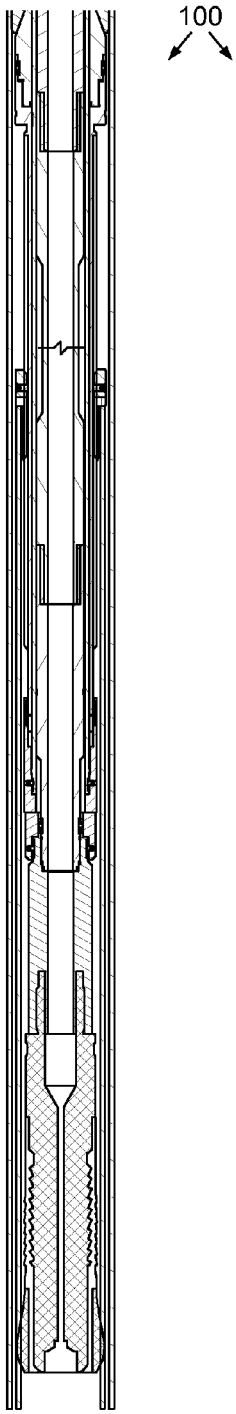
Figure 9G:
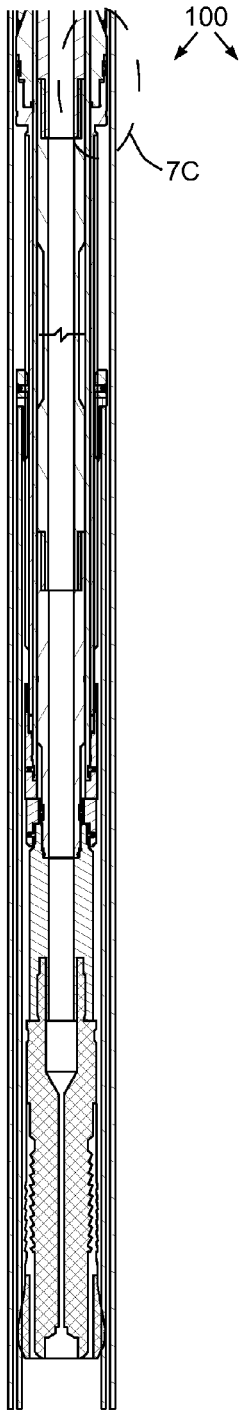
Figure 9H:
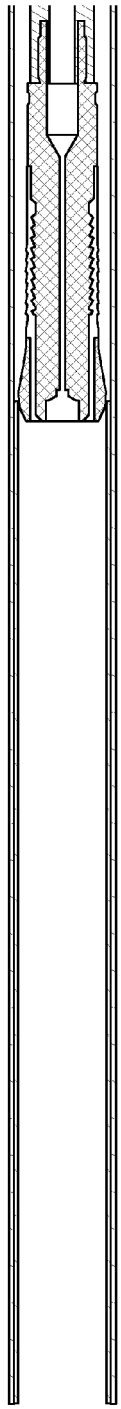

As the expander 112 approaches a top of the patch 110 (FIGS. 8E and 9E), the release nut 29 may engage the release sleeve 27 and fracture the shear ring 37, thereby freeing the release sleeve 27 from the retainer case 16. The release nut 29 may then push the release sleeve 27 and the release mandrels 9,13 until the shoulder 9*s* of the upper release mandrel 9 engages a bottom of the drag case 10 (FIGS. 8F and 9F). The release nut 29 may then push the drag case 10 (and connected slip retainer 12 and slips 19) upward away from the slip body 15, thereby retracting the slips 19 from engagement with the casing (FIGS. 7C, 8G and 9G) in the unzipping fashion discussed above. As the slips 19 are being unzipped, the snap ring 17 may engage the groove 13*g*. Once the slips 19 corresponding to the first flange pair 12*a* radially engage an outer surface of the upper adapter, the components 15, 16, and 18 may be pulled longitudinally upward by connection via the slips 19. Pulling of the conveyance 114 may continue until the patch 110 is fully expanded (FIGS. 8H and 9H). The setting tool 50 and anchor 1 may then be retrieved from the wellbore 101.

Returning to FIG. 2A, a return fluid path 165 for lubricant 160 circulation is also illustrated. The path 165 may include an annulus formed between the release sleeve 27 and (unexpanded) patch 110 and between the release nut 29 and the (unexpanded) patch 110 for return of the lubricant 160 injected through the setting tool 50 to the surface 105. The return fluid path 165 may also include the slots formed between the liner stop fingers 18*f* and circumferential spaces formed between the set slips 19 and between the drag blocks 8.

Figure 2B:
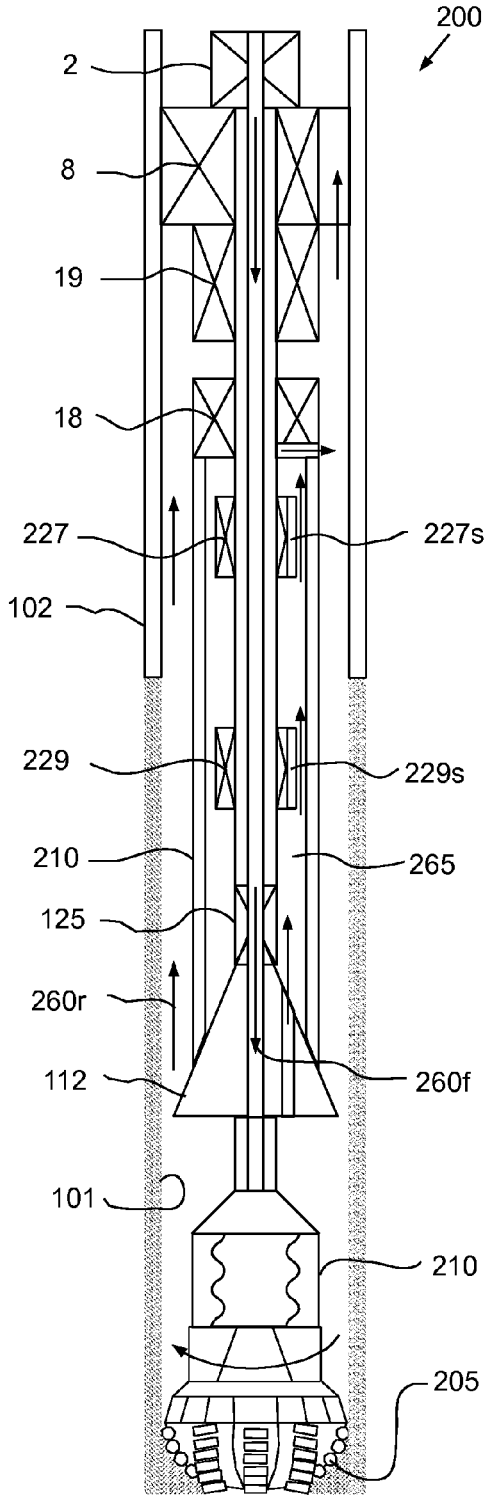
FIG. 2B illustrates operation of an alternative BHA equipped for a liner drilling operation, according to another embodiment of the present invention.

FIG. 2B illustrates operation of an alternative BHA 200 equipped for a liner drilling operation, according to another embodiment of the present invention. The BHA 200 may further include a drill bit 205 and a mud motor 210 for rotating the drill bit 205. Drilling fluid 260*f* injected through the conveyance 114, the setting tool 50, the mud motor 210, and the drill bit 205 may carry cuttings from the drill bit. Since flow of the drilling fluid and cuttings (returns 260*r*) may be obstructed by the expander 112, a bypass flow path 265 may be formed between the setting tool 50 and an expandable liner 210 and between the anchor 1 and the expandable liner. To enhance the bypass path 265, the release sleeve 227 may be slotted 227*s* and/or the release nut 229 may be slotted 229*s*. Alternatively, the anchor 1 may include the slotted release nut and/or the slotted release sleeve. Further, as shown, the BHA 200 is being drilled with the liner stop 18 in contact or proximity to a top of the expandable liner 210. Alternatively, the BHA 200 may be drilled with a substantial space between the liner stop 18 and the expandable liner 210.

The expandable liner 210 may be solid or perforated (i.e., slotted). If perforated, the expandable liner 210 may be constructed from one or more layers, such as three. The three layers may include a slotted structural base pipe, a layer of filter media, and an outer shroud. Both the base pipe and the outer shroud may be configured to permit hydrocarbons to flow through perforations formed therein. The filter material may be held between the base pipe and the outer shroud and may serve to filter sand and other particulates from entering the liner 210.

Additionally, either BHA 100, 200 may be operable to expand a first liner into engagement with open hole and then run a second liner through the expanded first liner and to expand the second liner into engagement with open hole. The second liner may have the same size diameter as the first liner (both pre and post expansion). The second liner may also be drilled into place. Alternatively, the pre-expansion and/or post-expansion diameter of the second liner may be slightly less than the first liner.

Alternatively, the spacer 40 may have an outer diameter greater than an inner diameter of the release sleeve and the spacer 40 may be used to engage and operate the release sleeve instead of the release nut.

Figure 10A:
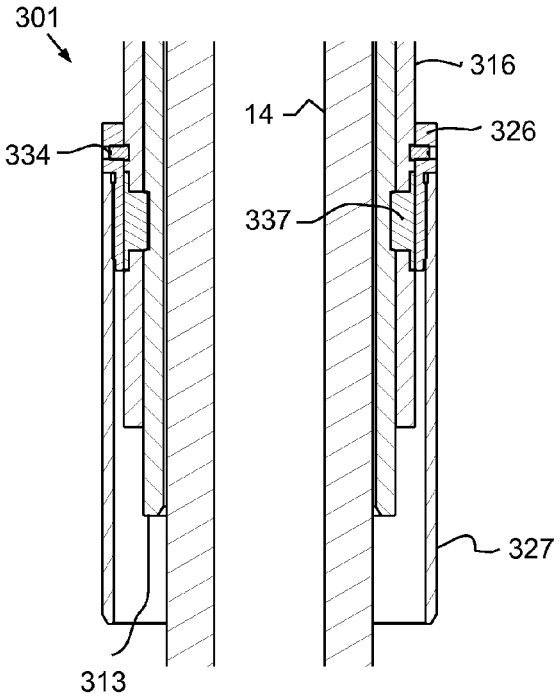
FIG. 10A illustrates a portion of an anchor, according to another embodiment of the present invention.
Figure 10B:
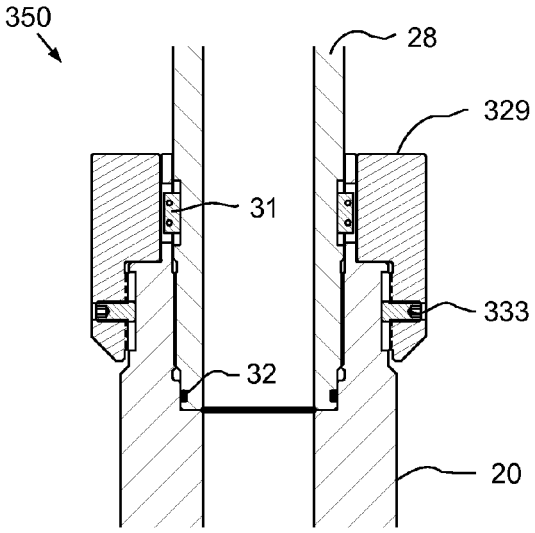
FIG. 10B illustrates a portion of an alternative setting tool for use with the anchor.
Figure 10C:
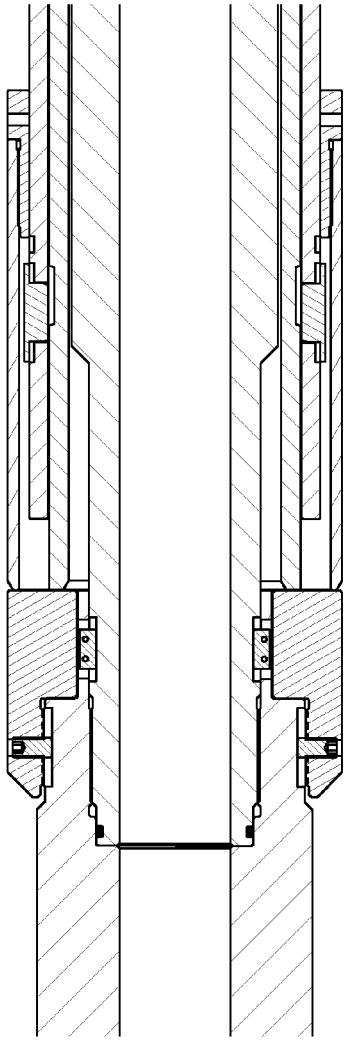
FIG. 10C illustrates operation of the setting tool and anchor portions.

FIG. 10A illustrates a portion of an anchor 301, according to another embodiment of the present invention. FIG. 10B illustrates a portion of an alternative setting tool 350 for use with the anchor 301. FIG. 10C illustrates operation of the setting tool and anchor portions. The rest of the anchor 301 and setting tool may be similar or identical to the anchor 1 and setting tool 50, respectively. The anchor 301 and setting tool 350 may be used as part of any of the BHAs 100, 200, discussed above, instead of the anchor 1 and setting tool 50, respectively.

A retainer sleeve 326 may be longitudinally and torsionally connected to the retainer case 316 (during deployment) by one or more frangible fasteners, such as shear screws 334. The release sleeve 327 may be longitudinally and torsionally connected to the retainer sleeve 326, such as by a threaded connection. The retainer case 316 may be longitudinally connected to the lower release mandrel 313 (during deployment) by one or more fasteners, such as dogs 337. The dogs 337 may be held in place by the retainer sleeve 326. A release trigger, such as a nut 329, may be longitudinally and torsionally connected to the bottom sub 20, such as by a threaded connection and one or more fasteners, such as set screws 333.

As the expander 112 approaches a top of the patch 110, the release nut 329 may engage the release sleeve 327 and fracture the shear screws 334, thereby freeing the retainer sleeve 326 from the retainer case 316. The release nut 329 may then push the retainer sleeve 326 from engagement with the dogs 337 and along the retainer case 316 until the release nut 329 engages a bottom of the lower release mandrel 313. The release nut 329 may then push the lower release mandrel 313 and movement of the lower release mandrel 313 may cause the dogs 337 to be pushed radially outward into an annulus formed between the release sleeve 327 and the retainer case 316, thereby freeing the lower release mandrel from the retainer case.

Additionally, the setting tool may include a cup seal (not shown) engaged with an inner surface of the expandable tubular to act as a debris barrier, a blocking member catcher (not shown), a float collar or shoe (not shown), a centralizer (not shown). Additionally, cement may be pumped into an annulus formed between the tubular and the casing/open hole before the tubular is expanded and in the same trip as expanding the tubular. Additionally, a lower and/or upper portion of the expandable tubular may include an anchor for engaging the casing/open hole during expansion of the tubular. Additionally, an upper portion of the tubular may include one or more seals for engaging an inner surface of the casing during expansion of the tubular. Alternatively, the anchor may be used with the hydraulic jack, discussed above.

Alternatively, the patch 110 may instead be an expandable liner hanger for a conventional liner string. The expander 112 may then be connected to an upper portion of the conventional liner (at or near a bottom of the hanger) and deployed to expand only the hanger. A float collar or shoe may be assembled as part of a lower portion of the liner string and one or more wipers may be assembled at a lower portion of the setting tool. Cement may then be pumped through the liner and into the annulus before the hanger is expanded and the top cement plug may be used to operate the anchor instead of having to pump and catch an additional blocking member, thereby obviating need for a blocking member catcher. The top plug and wiper may then release after operating the anchor.

Alternatively, the slips may be set against an open hole section instead of a cased section of the wellbore.

Alternatively, the anchor and setting tool of the '082 provisional may be used instead of the anchor 1 and setting tool 50. Notable differences include a dual valve piston/setting piston system instead of the piston/latch system and a release latch instead of the shear ring.

While the foregoing is directed to embodiments of the present invention, other and further embodiments of the invention may be devised without departing from the basic scope thereof, and the scope thereof is determined by the claims that follow.

What is claimed is:

1. A method of lining a wellbore or patching a casing of the wellbore, comprising:

deploying a bottom hole assembly (BHA) into the wellbore using a conveyance, the BHA comprising a latch longitudinally connecting an anchor to a setting tool, the setting tool having a piston locking the latch, the anchor, and an expandable tubular, and the anchor comprising an upper portion having a drag engaged with the casing and a slip retainer connected to the drag, an inner release mandrel, a lower portion having a stop for engagement with a top of the expandable tubular and a slip body connected to the stop, and slips longitudinally coupled to the slip retainer and the slip body and engaged with the release mandrel, thereby longitudinally supporting the lower portion;

operating the piston to unlock the latch by pressurizing a bore of the setting tool, thereby releasing the anchor from the setting tool; and after unlocking the latch, pulling the conveyance, thereby:

extending the slips into engagement with the casing, pulling an expander of the setting tool through the expandable tubular, and expanding the tubular into engagement with at least one of the casing and the wellbore and retracting the slips.

2. The method of claim 1, further comprising injecting lubricant through the conveyance and the setting tool during expansion of the tubular, wherein the lubricant returns to surface through an annular flow path formed between the setting tool and the expandable tubular and between the anchor and the expandable tubular.

3. The method of claim 1, wherein retracting the anchor comprises releasing a first pair of the slips and then releasing a second pair of the slips.

4. The method of claim 1, wherein the expandable tubular is expanded into engagement with a damaged portion of the casing.

5. The method of claim 1, wherein the expandable tubular is expanded into engagement with the wellbore.

6. The method of claim 5, wherein:

the BHA further comprises a drill bit and a mud motor, and the method further comprises injecting drilling fluid through the conveyance and the setting tool, thereby rotating the drill bit and drilling the wellbore.

7. The method of claim 6, wherein:

the drilling fluid carries cuttings from the drill bit, thereby forming returns, and the returns flow from the drill bit to surface through an annular flow path formed between the setting tool and the expandable tubular and between the anchor and the expandable tubular.

8. The method of claim 7, further comprising:

retrieving the conveyance, setting tool, and anchor to the surface;

redeploying the BHA with a second expandable tubular into the wellbore and into the expanded tubular using the conveyance; and further drilling the wellbore.

9. The method of claim 1, wherein the setting tool bore is pressurized by pumping a blocking member through the conveyance and seating the blocking member in the setting tool.

10. The method of claim 1, wherein:

the slip retainer has flanged portions;

each slip has a flanged portion for mating with a respective retainer flanged portion and an inclined portion having an inner surface and a profile;

the slip body has pockets, each pocket having an inclined outer surface and a profile and for mating with a respective slip inclined portion;

wherein:

the flanged portions are each inclined, and the flanged portions, pockets, and inclined portions are operable to radially extend the slips in response to relative longitudinal movement of the slip body toward the slip retainer, and the flanged portions, pockets, and inclined portions are operable to radially retract the slips in response to relative longitudinal movement of the slip retainer away from the slip body.

11. A bottom hole assembly (BHA) for lining a wellbore or patching a casing of the wellbore, comprising:

an anchor comprising:

a tubular drag operable to engage the casing of the wellbore;

a tubular slip retainer connected to the drag and having flanged portions;

slips, each slip having a flanged portion for mating with a respective retainer flanged portion and an inclined portion having an inner surface and a profile; and a tubular slip body having pockets, each pocket having an inclined outer surface and a profile and for mating with a respective slip inclined portion; and a release mandrel engaged with the slips when the slips are in a retracted position, wherein:

the flanged portions are each inclined, and the flanged portions, pockets, and inclined portions are operable to radially extend the slips in response to relative longitudinal movement of the slip body toward the slip retainer, the flanged portions, pockets, and inclined portions are operable to radially retract the slips in response to relative longitudinal movement of the slip retainer away from the slip body, and engagement of the slips with the release mandrel longitudinally supports the slip body; and a setting tool, comprising:

a tubular port mandrel having a bore therethrough and one or more ports formed through a wall thereof; and a piston in fluid communication with the ports and operable to lock and unlock a latch; and the latch operable to connect the port mandrel to the drag.

12. The BHA of claim 11, wherein:

the anchor comprises a first pair of the slips and a second pair of the slips, and the flanged portions are configured to release the first pair of the slips before releasing the second pair of the slips.

13. The BHA of claim 11, further comprising:

a retainer case connected to the slip body and having a threaded outer surface; and a nut engaged with the threaded outer surface and having slots formed through a wall thereof at an end thereof.

14. The BHA of claim 11, wherein:

the setting tool further comprises a release trigger connected to the port mandrel and operable to engage the release mandrel, and engagement of the release trigger with the release mandrel pushes the slip retainer away from the slip body.

15. The BHA of claim 14, wherein:

the anchor further comprises:

a retainer case connected to the slip body; and a first fastener operable to connect the retainer case to the release mandrel, and engagement of the release trigger with the release mandrel also releases the first fastener.

16. The BHA of claim 15, wherein:

the anchor further comprises a second fastener connected to the slip body and biased into engagement with the release mandrel, the release mandrel has a profile operable to receive a portion of the second fastener, release of the first fastener allows the second fastener to engage the profile, and engagement of the second fastener with the profile prevents re-extension of the slips.

17. The BHA of claim 11, wherein:

the setting tool further comprises an expander connected to the port mandrel, the BHA further comprises an expandable tubular releasably connected to the expander, and the anchor further comprises a stop connected to the slip body and operable to engage a top of the expandable tubular.

18. The BHA of claim 17, wherein:

the anchor further comprises a retainer case connected to the slip body and having a threaded outer surface, the stop is a nut engaged with the threaded outer surface and having slots formed through a wall thereof at an end thereof, and the slotted end of the nut is operable to engage the expandable tubular.

19. The BHA of claim 18, further comprising:

a mud motor connected to the expander and operable to rotate a drill bit; and the drill bit connected to the mud motor.

20. A method of lining a wellbore or patching a casing of the wellbore, comprising:

deploying a bottom hole assembly (BHA) into the wellbore using a conveyance, the BHA comprising a setting tool, an anchor, an expandable tubular, a drill bit and a mud motor;

injecting drilling fluid through the conveyance and the setting tool, thereby rotating the drill bit and drilling the wellbore, wherein:

the drilling fluid carries cuttings from the drill bit, thereby forming returns, and the returns flow from the drill bit to surface through an annular flow path formed between the setting tool and the expandable tubular and between the anchor and the expandable tubular;

pressurizing a bore of the setting tool, thereby longitudinally releasing the anchor from the setting tool; and pulling the conveyance, thereby:

extending the anchor into engagement with the casing, pulling an expander of the setting tool through the expandable tubular, and expanding the tubular into engagement with the wellbore and retracting the anchor.

21. The method of claim 20, further comprising:

retrieving the conveyance, setting tool, and anchor to the surface;

redeploying the BHA with a second expandable tubular into the wellbore and into the expanded tubular using the conveyance; and further drilling the wellbore.

* * * * *